US007612292B1

(12) United States Patent
Sim et al.

(10) Patent No.: US 7,612,292 B1
(45) Date of Patent: Nov. 3, 2009

(54) CURRENT LEAD USING RUTHERFORD CABLE

(75) Inventors: Ki Deok Sim, Gimhae-si (KR); Seok Ho Kim, Gimhae-si (KR); Jeon Wook Cho, Changwon-si (KR)

(73) Assignee: Korea Electrotechnology Research Institute (KR)

( * ) Notice: Subject to any disclaimer, the term of this patent is extended or adjusted under 35 U.S.C. 154(b) by 0 days.

(21) Appl. No.: 12/269,215

(22) Filed: Nov. 12, 2008

(30) Foreign Application Priority Data

Aug. 27, 2008 (KR) ..... 10-2008-0083646

(51) Int. Cl.
*H01B 5/00* (2006.01)

(52) U.S. Cl. ..... 174/126.1; 174/128.1; 174/129 R

(58) Field of Classification Search ..... 174/126.1, 174/127, 128.1, 128.2, 129 R, 129 B, 130, 174/131 R, 133 R
See application file for complete search history.

(56) References Cited

U.S. PATENT DOCUMENTS

| | | | | |
|---|---|---|---|---|
| 4,529,837 | A * | 7/1985 | Borden | 174/125.1 |
| 6,746,991 | B2 * | 6/2004 | Rey et al. | 505/470 |
| 2001/0027166 | A1 * | 10/2001 | Snitchler et al. | 505/430 |
| 2003/0024818 | A1 * | 2/2003 | Albrecht et al. | 204/622 |
| 2005/0227873 | A1 * | 10/2005 | Leghissa | 505/430 |
| 2006/0089264 | A1 * | 4/2006 | Hong | 505/100 |
| 2007/0042910 | A1 * | 2/2007 | Puigsegur et al. | 505/100 |

* cited by examiner

*Primary Examiner*—William H Mayo, III
(74) *Attorney, Agent, or Firm*—Park & Associates IP Law LLC

(57) ABSTRACT

A normal conducting current lead using Rutherford cables, in which one end thereof is connected to an external power supplier and the other end thereof is connected to a superconducting current lead connected to a superconducting power apparatus operating at ultralow temperatures. The normal conducting current lead includes an insulating body, which has a cylindrical shape or a polygonal prism shape and a plurality of slots radially formed from the center thereof, and a plurality of Rutherford cables, which are inserted and fitted into the slots of the insulating body and are radially arranged so that a density of current flowing through the cross-section of the current lead is uniformly distributed.

10 Claims, 4 Drawing Sheets

CURRENT LEAD USING RUTHERFORD CABLE

FIELD OF THE INVENTION

The present invention relates to a current lead using Rutherford cables, and more particularly, to a current lead using Rutherford cables, which is suitable for use as a normal conducting current lead which connects an external power supplier and a superconducting power apparatus to supply current to the superconducting power apparatus and which causes current flowing through the cross-section of the normal conducting current lead to be uniformly distributed.

BACKGROUND OF THE INVENTION G enerally, a superconducting power apparatus which is operated at ultra-low temperatures is essentially composed of a current lead for supplying large current at from room temperature (300K) to an ultra-low temperature (77K).

Specifically, FIG. 1 shows the structure of a general superconducting power apparatus. As shown in the drawing, the superconducting power apparatus received in an ultra-low temperature container 1 is connected with an ultra-low temperature freezer 3 for ultra-low temperature cooling. Further, in order to supply current to the superconducting power apparatus from the outside, a normal conducting current lead 4 connected to an external power supplier is provided in the temperature range from 300 K to 77 K, and also, in the ultra-low temperature range below 77K, a superconducting current lead 5 which is connected to the superconducting power apparatus 2 is provided.

The normal conducting current lead 4 is designed to generate Joule heat in a predetermined amount and to have minimum heat conductivity, such that the normal conducting current lead 4 is prevented from being cooled due to the superconducting current lead 5 and heat penetration from the outside is minimized.

To this end, the shape of the normal conducting current lead 4 is determined to optimally generate Joule heat at maximum rated current and to minimize the heat conductivity.

That is, when the material for the current lead is determined according to being that which provides for the optimal generation of Joule heat and the minimization of heat conductivity, applied current (I), the length (L) of the current lead, and the cross-sectional area (A) of the current lead are determined according to the relationship of $I \times L/A = C$ (constant), in which C is the value which is determined depending on the type of material.

Recently, as the capacity of the superconducting power apparatus has increased, the demand for application of large current is increasing. In order to comply therewith, there is a need for a current lead having a large cross-section so as to enable the application of a large amount of current.

As seen with reference to the above relationship, when the current (I) is increased at a predetermined length (L), the cross-sectional area (A) must be increased.

However, as known in the art, when current (alternating current) flows through a conductor, it is concentrated on the surface of the conductor. That is, the current density is increased as close to the surface of the conductor.

A drawing for explaining such a phenomenon is depicted in FIG. 2. FIG. 2 is a perspective view showing a conventional normal conducting current lead and a graph showing the distribution of current flowing through the cross-section thereof.

As shown in FIG. 2, the current density is exponentially increased in proportion to the increase in the radial distance from the center of the conductor or in proceeding toward the outer surface of the conductor.

Due to such a phenomenon, the cross-sectional area of the current lead should be large so as to transmit large current, and accordingly, the volume and weight of the current lead are increased.

Further, as mentioned above, a current lead having at least a predetermined length should be ensured to minimize the heat penetration. So, it is not easy to reduce the weight of the current lead.

With the aim of solving such problems, the current lead may be manufactured in the form of a tube. If so, the weight of the current lead may be reduced but the diameter thereof should be maintained as it is, thus making it impossible to reduce the size of the current lead.

Hence, the current lead having a large cross-sectional area must be used, but a difficulty comes about in terms of a manufacturing process, and also the size of the superconducting power apparatus is increased, making it difficult to reduce the total size of the system.

SUMMARY OF THE INVENTION

Accordingly, the present invention has been made keeping in mind the above problems occurring in the related art, and the present invention provides a current lead using Rutherford cables, in which Rutherford cables are radially arranged so that current flowing through the cross-sectional area of the current lead is uniformly distributed, thus realizing a relatively small cross-sectional area and enabling the application of a large amount of current.

According to the present invention, a current lead using Rutherford cables, suitable for use as a normal conducting current lead in which one end thereof is connected to an external power supplier and the other end thereof is connected to a superconducting current lead connected to a superconducting power apparatus operating at ultra-low temperatures in order to supply current to the superconducting power apparatus, may comprise an insulating body, which has a cylindrical shape or a polygonal prism shape and a plurality of slots radially formed from the center thereof, and a plurality of Rutherford cables, which are inserted and fitted into the slots of the insulating body and are radially arranged so that a density of current flowing through the cross-section of the current lead is uniformly distributed.

Preferably, the Rutherford cables are formed in a bar shape by subjecting a plurality of wire strands respectively covered with an insulating coating to helical twisting and then compression.

Preferably, the wire strands are formed of copper.

Preferably, the insulating body is formed of fiberglass reinforced plastics (FRP).

In addition, a current lead using Rutherford cables, which has a large capacity, may comprise an insulating body, which has a cylindrical shape or a polygonal prism shape and a plurality of slots radially formed from the center thereof, and a plurality of Rutherford cables, which are inserted and fitted into the slots of the insulating body and are radially arranged so that a density of current flowing through the cross-section of the current lead is uniformly distributed.

Preferably, the Rutherford cables are formed in a bar shape by subjecting a plurality of wire strands respectively covered with an insulating coating to helical twisting and then compression.

Preferably, the wire strands are formed of copper.

Preferably, the insulating body is formed of FRP.

DETAILED DESCRIPTION OF THE INVENTION

Hereinafter, a detailed description will be given of the present invention, with reference to the appended drawings.

Figure 1:
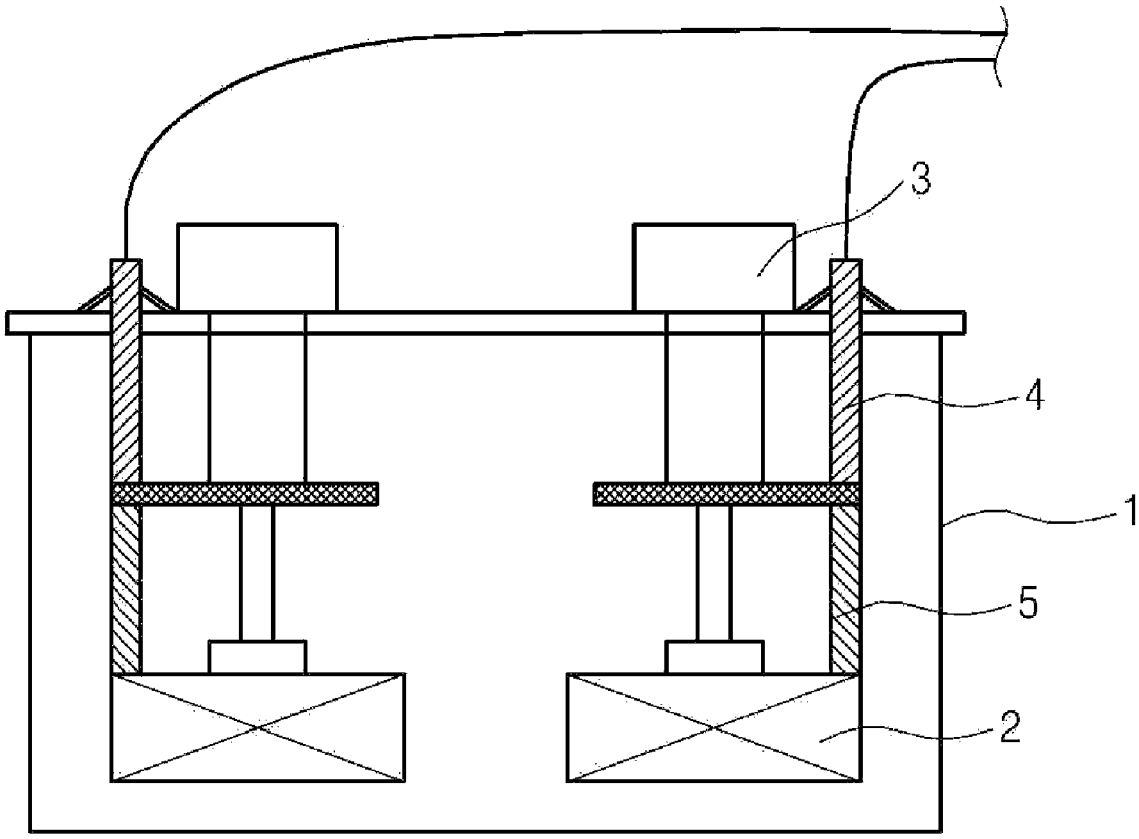
FIG. 1 is a view showing a general superconducting power apparatus.
Figure 2:
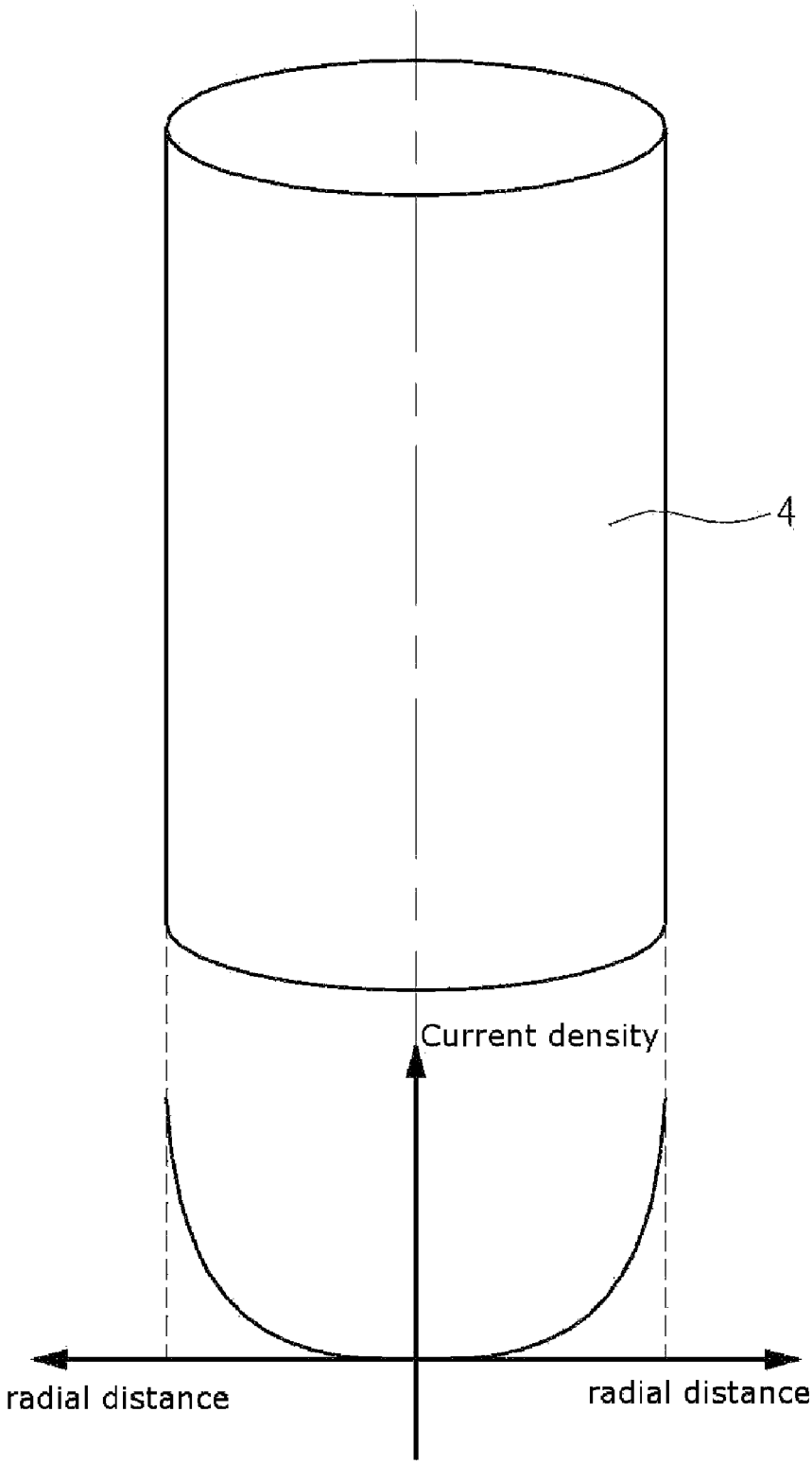
FIG. 2 is a perspective view showing a conventional normal conducting current lead and a graph showing the distribution of current flowing through the cross-section thereof.
Figure 3:
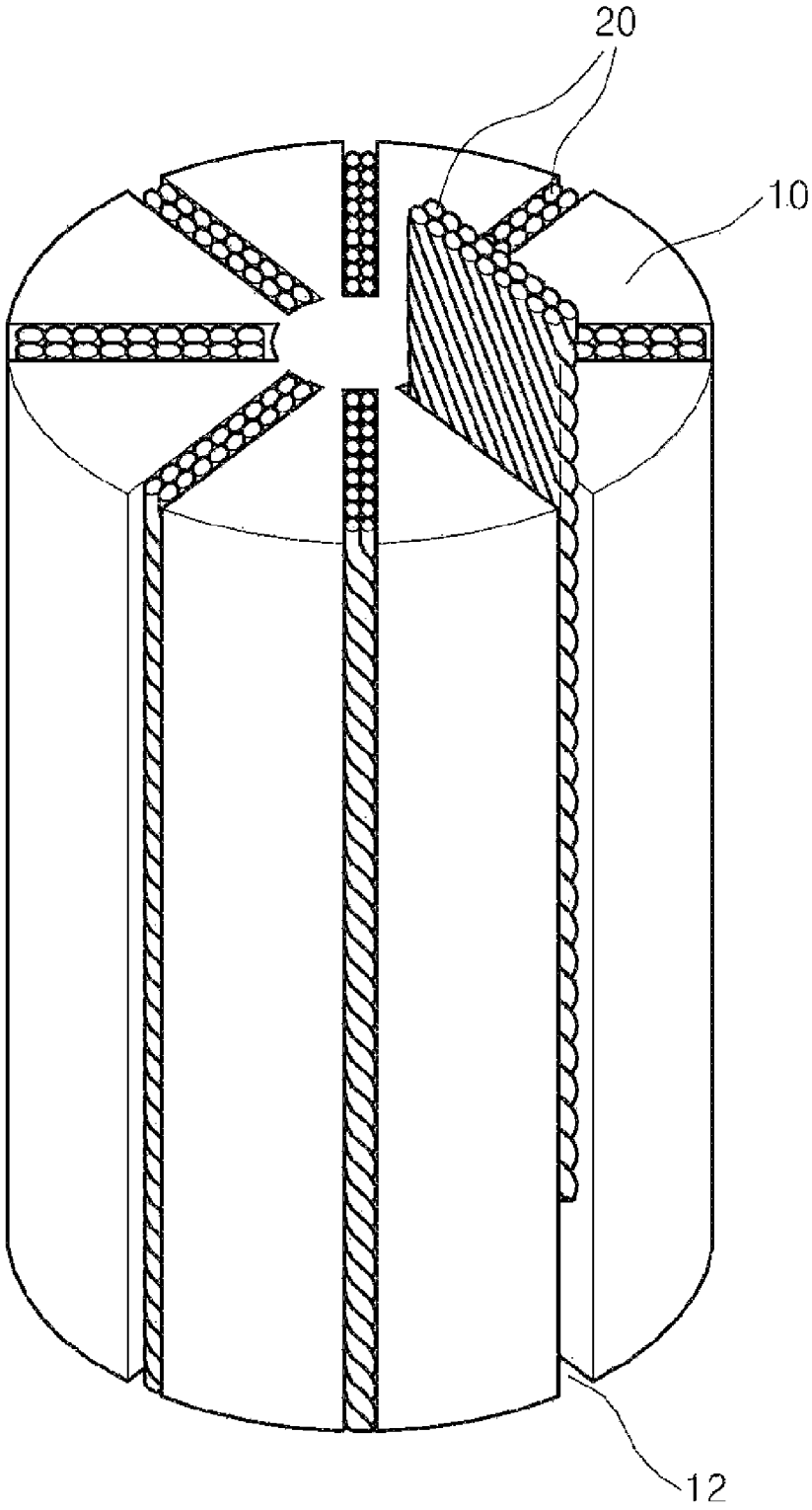
FIG. 3 is a view showing a normal conducting current lead using Rutherford cables according to the present invention.
Figure 4:
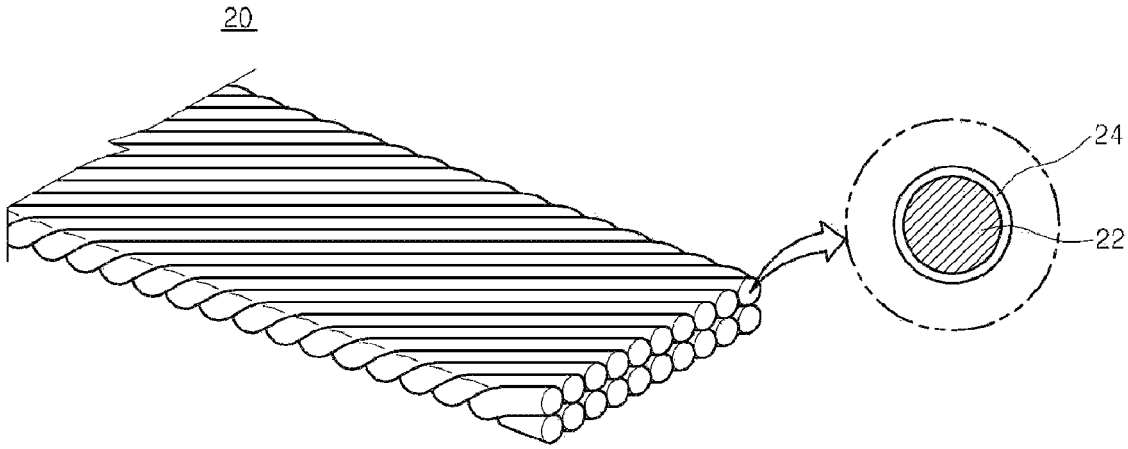
FIG. 4 is a perspective view showing the Rutherford cable of FIG. 3.

FIG. 3 is a view showing a current lead using Rutherford cables according to a preferred embodiment of the present invention, and FIG. 4 is a perspective view showing the Rutherford cable of FIG. 3.

According to the present invention, the current lead includes an insulating body 10 having a cylindrical shape or a polygonal prism shape and a plurality of Rutherford cables 20 in a bar form, in which the Rutherford cables 20 are radially arranged outward from the center of the insulating body 10.

In the present invention, the current lead indicates a normal conducting current lead.

The insulating body 10 is described below.

The insulating body 10 typically has a cylindrical shape or a polygonal prism shape, and preferably has a cylindrical shape from the structural point of view. When the current lead has a circular cross-section, Rutherford cables 20 may be radially arranged as mentioned below. So, it is preferred that the cross-section of the current lead be circle.

Examples of the material for the insulating body 10 include any materials for electrical insulation and heat insulation, such as synthetic resins and rubbers. Particularly useful is FRP having superior heat insulation and electrical insulation properties.

Further, the insulating body 10 has slots 12 into which the Rutherford cables 20 in a bar form are to be inserted and fitted.

As seen in the drawing, a plurality of the slots 12 is formed radially from the center of the insulating body 10 and is disposed in a longitudinal direction thereof. The slots 12 have a thin rectangular parallelepiped shape and are angularly spaced apart from each other by predetermined intervals. Specifically, the slots 12 are not arranged to lead to the center of the insulating body 10 but are radially arranged from a position spaced at a predetermined distance from the center of the insulating body. The slots 12 are angularly spaced apart from each other by predetermined intervals, and the intervals therebetween are proportionally increased toward the outer circumference of the insulating body.

Although the conventional current lead is disadvantageous because it is formed of conductive metal and is thus considerably heavy, the use of the insulating body as in the present invention can advantageously reduce the total weight of the current lead.

Figure 5:
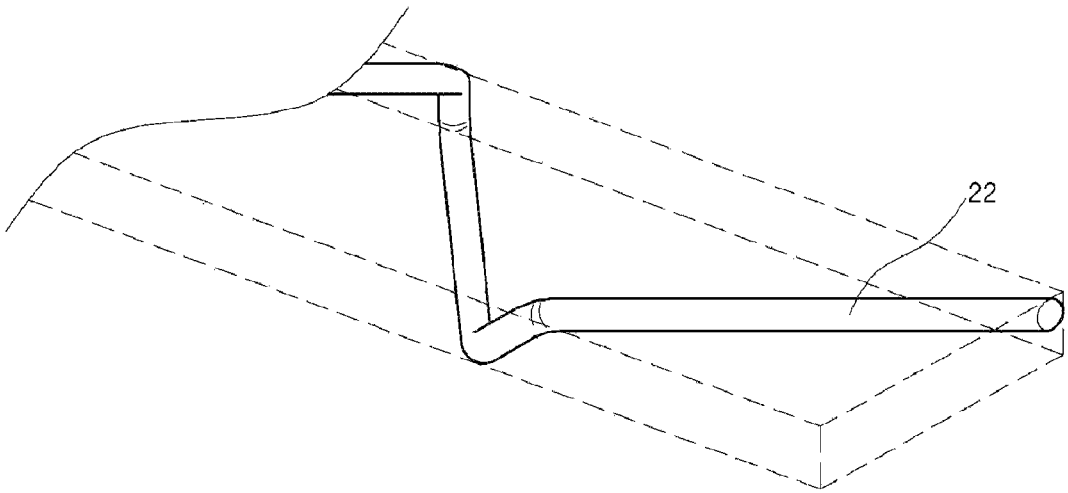
FIG. 5 is a perspective view showing the manner of twisting the wire strand of the Rutherford cable of FIG. 4.

With reference to FIG. 5, the Rutherford cable 20 is described below.

FIG. 5 is a perspective view showing the manner of twisting the wire strand of the Rutherford cable of FIG. 4.

As known in the art, the Rutherford cable 20 is formed in a bar shape by subjecting a plurality of wire strands 22 to twisting and then compression. As shown in FIGS. 4 and 5, the wire strands 22 are helically twisted in the same direction.

Specifically, the Rutherford cable 20 is manufactured using a special cabling machine. The wire strands 22 thereof are circumferentially disposed around a virtual circle at predetermined intervals, and all of the wire strands 22 are helically twisted in a unidirection. As such, when the intervals of the wire strands 22 are gradually decreased and they come into close contact with each other, they form a cylindrical shape. In this state, when the wire strands 22 are rolled using upper and lower rollers, they are compressed thin so that they are in close contact with each other and arranged in two layers, thus obtaining a thin bar shape or a ribbon shape as shown in FIG. 4.

The wire strands 22 are formed of copper having high conductivity and are covered with an insulating coating 24. The insulating coating 24 is formed of synthetic resin or rubber.

Further, the Rutherford cables 20 are inserted and fitted into the slots 12 formed in a longitudinal direction of the insulating body 10, and thereby are radially arranged outward from the center of the insulating body 20.

Accordingly, the average density distribution of current flowing through the cross-section of the current lead thus structured is uniform, so that current can uniformly flow through the entire cross-section of the current lead. Therefore, when a large amount of current is intended to be applied, the current lead having a relatively small cross-sectional area according to the present invention is used, without the need to increase the cross-sectional area of the current lead as in the conventional case, thus enabling the application of a large amount of current.

Depending on the current capacity, the number of Rutherford cables 20 may be adjusted. That is, the Rutherford cables 20 are further added and arranged in a state in which the cross-sectional area of the current lead is maintained uniform, whereby the current capacity can be increased.

As well, because the wire strands 22 of the Rutherford cables 20 are helically twisted such that wire strands 22 in the upper and lower layers intersect with each other in a zigzag manner, current flows along the same pathway. As such, the magnetic fields occurring on the adjacent wire strands 22 in the upper and lower layers may be mutually offset, and thus, the current lead of the present invention is stable under electromagnetic conditions.

Further, because the wire strands 22 are not in a linear structure but are in a helically twisted structure, heat penetration is minimized. Although the conventional current lead should have at least a predetermined length to prevent the penetration of heat, in the present invention, the heat penetration can be minimized by means of the current lead having a relatively shorter length thanks to the use of the Rutherford cables. Because the wire strands 22 having a length adequate for reducing the heat penetration are helically twisted, the length of the Rutherford cable 20 is actually shorter than that of the wire strand thereof. Hence, the current lead according to the present invention can have a much shorter length than that of the conventional current lead and can also minimize the heat penetration.

Conclusively, the use of the insulating body 10 and the Rutherford cables 20 in the present invention is advantageous because the diameter and length of the current lead required to apply large current are drastically reduced, thus realizing a small current lead. Further, the weight thereof can be reduced, thus ensuring a lightweight current lead. Thereby, it is possible to manufacture a small superconducting power apparatus system.

As described hereinbefore, the present invention provides a current lead using Rutherford cables. According to the present invention, the current lead is advantageous because current can flow at a uniform current density over the cross-section of the current lead, and thus the cross-sectional area and length of the current lead can be reduced, thereby realizing a small lightweight current lead.

Therefore, a superconducting power apparatus system can be manufactured to have a small size yet be of a large capacity.

Although the preferred embodiments of the present invention regarding the small lightweight current lead in which the Rutherford cables are radially arranged in the insulating body so that the density of current flowing through the cross-section of the current lead is uniformly distributed have been disclosed for illustrative purposes, those skilled in the art will appreciate that various modifications, additions and substitutions are possible, without departing from the scope and spirit of the invention as disclosed in the accompanying claims.

What is claimed is:

1. A current lead using Rutherford cables, suitable for use as a normal conducting current lead in which one end thereof is connected to an external power supplier and the other end thereof is connected to a superconducting current lead connected to a superconducting power apparatus operating at ultra-low temperatures in order to supply current to the superconducting power apparatus, the current lead comprising:

an insulating body, which has a cylindrical shape or a polygonal prism shape and a plurality of slots radially formed from a center thereof; and a plurality of Rutherford cables, which are inserted and fitted into the slots of the insulating body and are radially arranged so that a density of current flowing through a cross-section of the current lead is uniformly distributed.

2. The current lead according to claim 1, wherein the Rutherford cables are formed in a bar shape by subjecting a plurality of wire strands respectively covered with an insulating coating to helical twisting and then compression.

3. The current lead according to claim 2, wherein the wire strands are formed of copper.

4. The current lead according to claim 2, wherein the insulating body is formed of fiberglass reinforced plastics.

5. The current lead according to claim 1, wherein the insulating body is formed of fiberglass reinforced plastics.

6. A current lead using Rutherford cables, which has a large capacity, comprising:

an insulating body, which has a cylindrical shape or a polygonal prism shape and a plurality of slots radially formed from a center thereof; and a plurality of Rutherford cables, which are inserted and fitted into the slots of the insulating body and are radially arranged so that a density of current flowing through a cross-section of the current lead is uniformly distributed.

7. The current lead according to claim 6, wherein the Rutherford cables are formed in a bar shape by subjecting a plurality of wire strands respectively covered with an insulating coating to helical twisting and then compression.

8. The current lead according to claim 7, wherein the wire strands are formed of copper.

9. The current lead according to claim 7, wherein the insulating body is formed of fiberglass reinforced plastics.

10. The current lead according to claim 6, wherein the insulating body is formed of fiberglass reinforced plastics.

* * * * *